US008451210B2

(12) United States Patent
Lv

(10) Patent No.: US 8,451,210 B2
(45) Date of Patent: May 28, 2013

(54) SYSTEM AND METHOD FOR AUTOMATICALLY ADJUSTING LUMINANCE OF BACKLIGHT SOURCE

(75) Inventor: Zhichao Lv, Beijing (CN)

(73) Assignee: Beijing BOE Optoelectronics Technology Co., Ltd., Beijing (CN)

( * ) Notice: Subject to any disclaimer, the term of this patent is extended or adjusted under 35 U.S.C. 154(b) by 1220 days.

(21) Appl. No.: 12/045,815

(22) Filed: Mar. 11, 2008

(65) Prior Publication Data

US 2008/0266238 A1 Oct. 30, 2008

(30) Foreign Application Priority Data

Apr. 25, 2007 (CN) ..... 2007 1 0098705

(51) Int. Cl.
*G09G 3/36* (2006.01)

(52) U.S. Cl.
USPC ..... 345/102

(58) Field of Classification Search
USPC ..... 345/87, 102, 204, 207; 250/205; 257/447
See application file for complete search history.

(56) References Cited

U.S. PATENT DOCUMENTS

| | | | | |
|---|---|---|---|---|
| 7,973,759 | B2 * | 7/2011 | Huang et al. | 345/102 |
| 8,040,341 | B2 * | 10/2011 | Lin | 345/212 |
| 2006/0007097 | A1 | 1/2006 | Ichikawa | |

FOREIGN PATENT DOCUMENTS

| | | |
|---|---|---|
| CN | 1774665 A | 5/2006 |
| CN | 1794044 | 6/2006 |

* cited by examiner

*Primary Examiner* — Abbas Abdulselam
(74) *Attorney, Agent, or Firm* — Ladas & Parry LLP

(57) ABSTRACT

The present invention relates to a backlight-source-luminance auto-adjusting system including a backlight source, a photosensitive element being mounted on the backlight source for converting a light signal into an electric signal; an amplification/conversion circuit for amplifying a received analog signal and converting the analog signal into a digital signal; a control circuit for receiving a signal sent by the amplification/conversion circuit and adjusting the backlight source; and a device operating board. The present invention also relates to a backlight-source-luminance auto-adjusting method comprising: receiving a light signal of a backlight source and converting the light signal into an electric signal to be amplified and then converted into a digital signal; comparing a current value corresponding to the digital signal with a qualified current value corresponding to a set luminance of the backlight source; and controlling an output voltage of a control circuit and adjusting the backlight source, according to the comparison result. The backlight-source-luminance auto-adjusting system and method of the present invention can change the existing manually adjusting manner, improve the stability of backlight source luminance, realize automatic turning on and off of the backlight source, and slow aging of the device.

11 Claims, 4 Drawing Sheets

SYSTEM AND METHOD FOR AUTOMATICALLY ADJUSTING LUMINANCE OF BACKLIGHT SOURCE

FIELD OF THE INVENTION

The present invention relates to a backlight-source-luminance auto-adjusting system and method, and particularly to a system and method capable of automatically adjusting luminance of a backlight source.

BACKGROUND OF THE INVENTION

With spreading of Liquid Crystal Display (LCD), more attentions have been drawn to LCD, especially the Thin Film Transistor-Liquid Crystal Display (TFT-LCD), and requirement to the quality of picture thereof is growing. Thus, manufactures producing the TFT-LCDs are required to perform restrict parameter tests on the TFT-LCD panels to ensure the quality of products.

Existing tests of TFT-LCD panels are realized by input a variable electric signal to a signal input of the TFT-LCD panels so as to obtain different examination pictures. However, TFT-LCD is a passive display device which will not radiate light by itself. It realizes the image display by using the electro-optical effect of the liquid crystal and controlling the light intension of displaying part through an alternative electric field, thus an important premise for carrying out tests of TFT-LCD panels is to have a backlight source for providing a constant luminance for the tests, so that stable gray scale can be ensured in the tested picture. Bad detection rate of TFT-LCD panels also depends on the stability of luminance of the backlight source directly. If abnormality occurs in the backlight source which decreases or increases the luminance in testing, it is hard to be recognized by human eyes, and has to be measured by specific testing instruments and then be adjusted manually, which is time-consuming, and there are errors in the manual adjustment.

SUMMARY OF THE INVENTION

An object of embodiments of the present invention is to provide a system and method for automatically adjusting luminance of a backlight source, which change the existing manual adjustment manner, and improve the stability of luminance of the backlight source.

Another object of embodiments of the present invention is to provide a system and method for automatically adjusting luminance of a backlight source, which are capable of achieving automatic turning-on and turning-off of the backlight source, saving electric power and slowing aging of the device.

Therefore, the embodiments of the present invention provide a backlight-source-luminance auto-adjusting system including a backlight source; a photosensitive element mounted on the backlight source for converting a light signal into an electric signal; an amplification/conversion circuit connected to the photosensitive element for amplifying a received analog signal and converting the analog signal into a digital signal; and a control circuit connected to the amplification/conversion circuit and the backlight source, for receiving a signal sent by the amplification/conversion circuit and adjusting the backlight source. The amount of said photosensitive elements is one or more. Said photosensitive element is a photosensor or a photodiode or a photoresistor. Said photosensitive element is mounted on front face and/or back face of the backlight source. Said amplification/conversion circuit comprises an operational amplification module for amplifying the received analog signal; and a conversion module connected to the operational amplification module for converting the analog signal into the digital signal. Said conversion module is an A/D conversion circuit or an AD/DA conversion circuit. Said control circuit comprises: a microprocessor for providing a control signal for adjusting the backlight source; a memory connected to the microprocessor for storing a quantified current value corresponding to a set luminance of the backlight source, as well as a preset time; a receiving module connected to the microprocessor for receiving an externally input signal; a comparison module connected to the microprocessor for comparing a current value corresponding to the received digital signal with the quantified current value corresponding to the set luminance of the backlight source; and a control module connected to the microprocessor for controlling a level of an input voltage to the backlight source according to the control signal from the microprocessor, adjusting the luminance of the backlight source, and turning on or off the backlight source according to the control signal. Said control module includes a current switch for controlling the turning on or off of the backlight source. Said microprocessor is a single-chip processor or PLC. The system further includes a device operating board connected to the control circuit. The device operating board comprises a hardware platform for providing an operation platform for parameter setting by a user; and a software platform for providing an operation signal of turning on or off the backlight source. Said photosensitive element, amplification/conversion circuit, control circuit, and device operating board communicate with each other in a wired or wireless manner.

The embodiments of the present invention also provide a backlight-source-luminance auto-adjusting method comprising receiving a light signal of a backlight source and converting the light signal into an electric signal; amplifying the converted electric signal and converting the amplified analog signal into a digital signal; comparing a current value corresponding to the digital signal with a qualified current value corresponding to a set luminance of the backlight source; and controlling an output voltage of a control circuit to increase or decrease, and adjusting to increase or decrease the luminance of the backlight source, according to the comparison result. Said method further comprising the control circuit turning on the backlight source when receiving a turning-on signal, and further comprising the control circuit turning off the backlight source when receiving a turning-off signal or not receiving any operation signal for a predetermined period.

Technical solutions of the present invention will be further described in conjunction with figures and particular embodiments.

DETAILED DESCRIPTION OF THE PREFERRED EMBODIMENTS

First Embodiment

Figure 1:
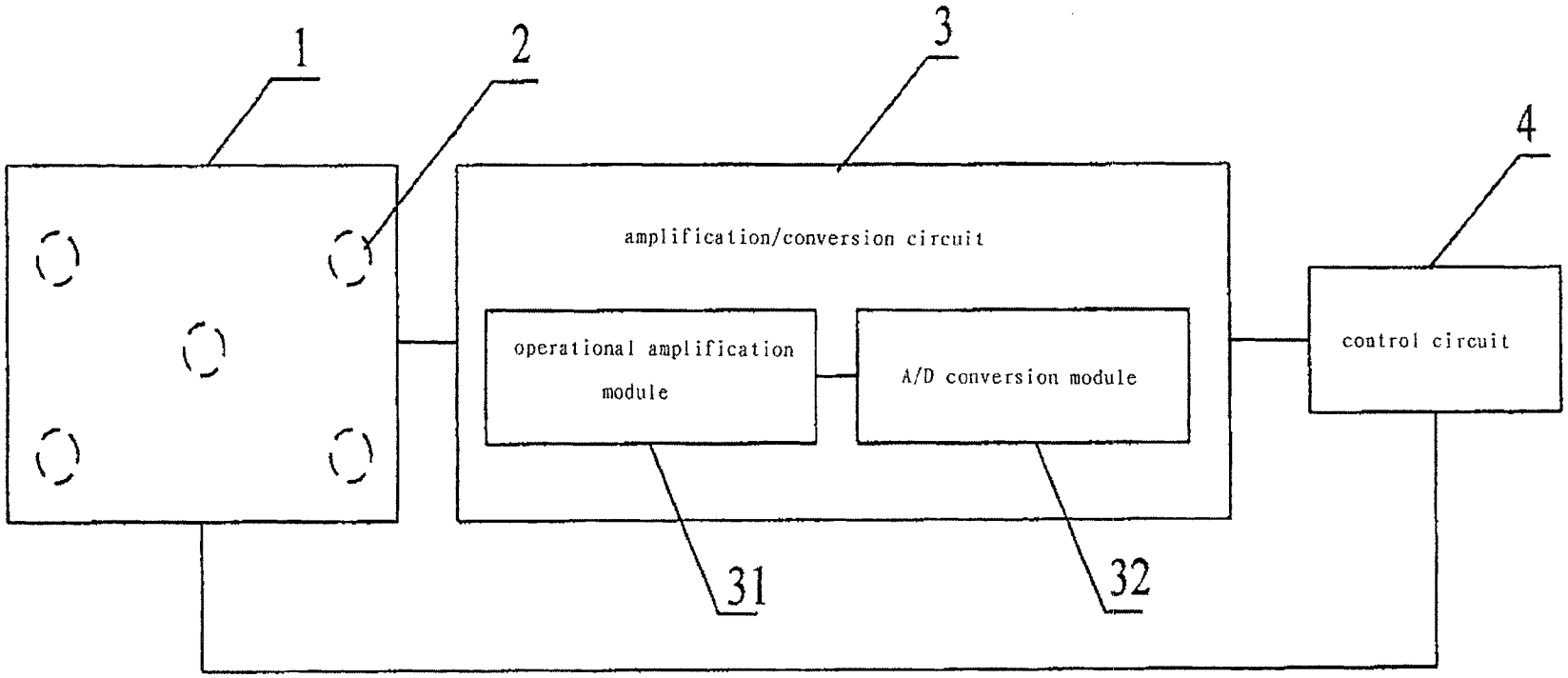
FIG. 1 is a schematic view of structure of a system for automatically adjusting luminance of a backlight source of a first embodiment of the present invention.

As shown in FIG. 1, the backlight-source-luminance auto-adjusting system including a backlight source 1, a photosensor 2, an amplification/conversion circuit 3, and a control circuit 4. The backlight source 1 provides light source for panel tests. The photosensitive element 2 is mounted on back side of the backlight source 1 for converting a light signal into an electric signal. Since the electric signal output from the photosensor 2 or other photosensitive elements is an analog signal which is not suitable for computer processing, the electric signal should be converted into a digital signal. Also, since change in the light of the backlight source is relatively small and thus the electric signal output from the photosensor is relatively weak, the electric signal should be amplified. These two functions are performed by the amplification/conversion circuit 3 which includes an operational amplification module 31 and an A/D conversion module 32. The operational amplification module 31 amplifies the electric signal sent by the photosensor 2. The A/D conversion module 32 is connected to the operational amplification module 31, and converts the analog signal output from the operational amplification module 31 into a digital signal. The A/D conversion module may also be an AD/DA conversion module or other functional modules that can convert an analog signal into a digital signal. After the amplification and the analog-to-digital conversion, the digital signal is transferred to the control circuit 4 for adjusting the luminance of the backlight source. In the signal gathering process, the photosensor 2 may be influenced by external factors, resulting in large interference in the gathered signal. In this time, a filtering module may be incorporated into the amplification/conversion circuit to eliminate the interference.

Figure 2:
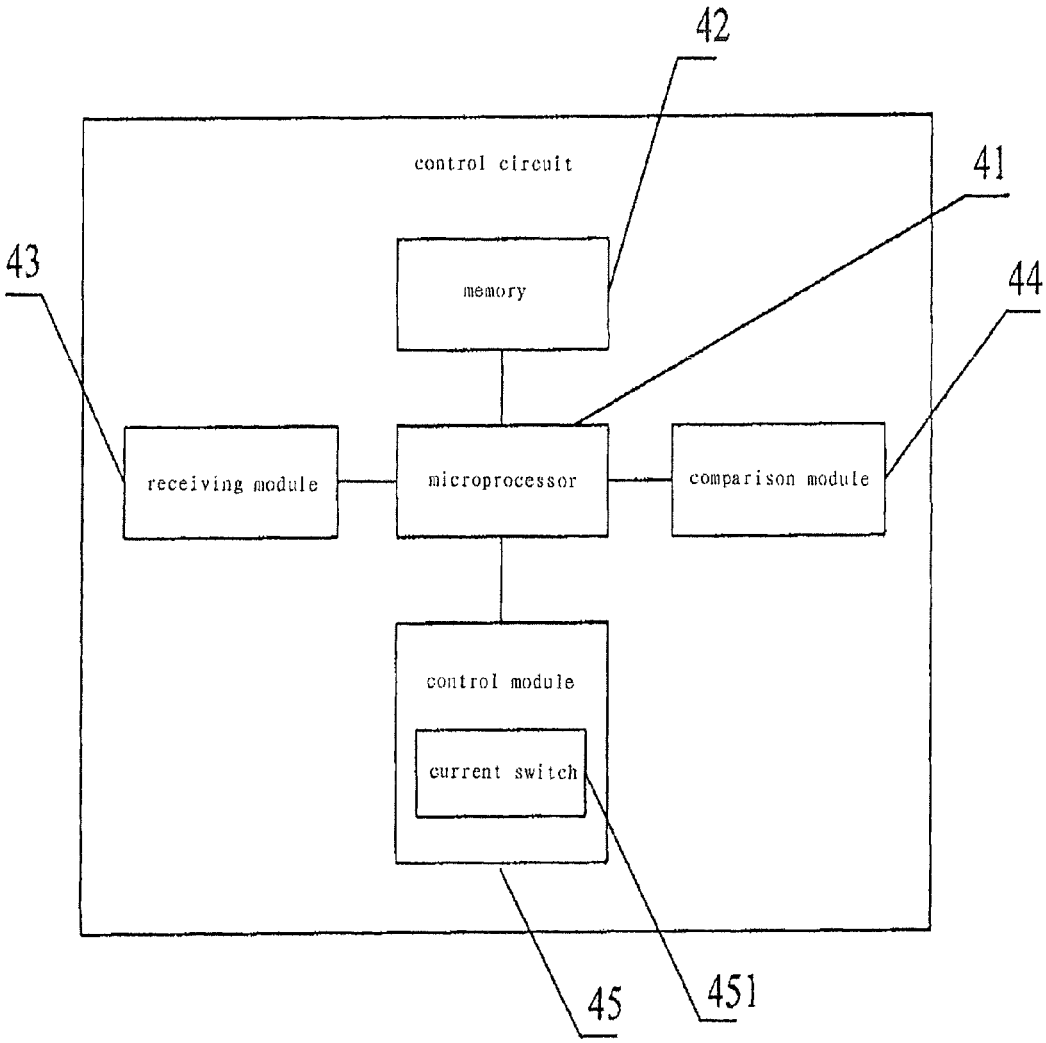
FIG. 2 is a schematic view of structure of a control circuit of the system of the present invention.

As shown in FIG. 2, the control circuit 4 is connected to the amplification/conversion circuit 3 and the backlight source 1, and includes a memory 42, a receiving module 43, a comparison module 44 and a control module 45 connected to a microprocessor 41, respectively. The microprocessor 41 may be a single-chip processor or a Programmable Logic Controller (PLC). The respective functional modules communicate through the microprocessor, and the microprocessor controls the respective functional modules to perform their respective functions, so as to provide a control signal for adjusting the backlight source. The memory 42 stores a quantified current values corresponding to each luminance of the backlight source to provide a reference data for comparison by the comparison module 44. The memory also stores a preset time. The receiving module 43 receives an externally input signal. The comparison module 44 compares a current value corresponding to the received digital signal with the quantified current value corresponding to a set luminance of the backlight source. The control module 45 controls a level of input voltage of the backlight source according to the control information from the microprocessor, adjusts the luminance of the backlight source, and turns on or off the backlight source according to the control information.

After the receiving module 43 receives the digital signal sent by the amplification/conversion circuit 3, it sends the digital signal to the microprocessor 41. The microprocessor 41 sends said digital signal to the comparison module 44, query the current value corresponding to a normal luminance of the backlight source in the memory 42, and sends it to the comparison module 44. The comparison module 44 compares the current value corresponding to the received digital signal with the quantified current value corresponding to the set luminance of the backlight source, and returns the comparison result to the microprocessor 41. Then the microprocessor 41 provides the control signal to the control module 45 according to the comparison result. The control module 45 adjusts the output voltage of the control circuit according to the control signal sent from the microprocessor 41. The output voltage of the control circuit is the input voltage of the backlight source 1. Thereby the luminance of the backlight source can be adjusted by adjusted the input voltage of the backlight source 1.

Second Embodiment

Figure 3:
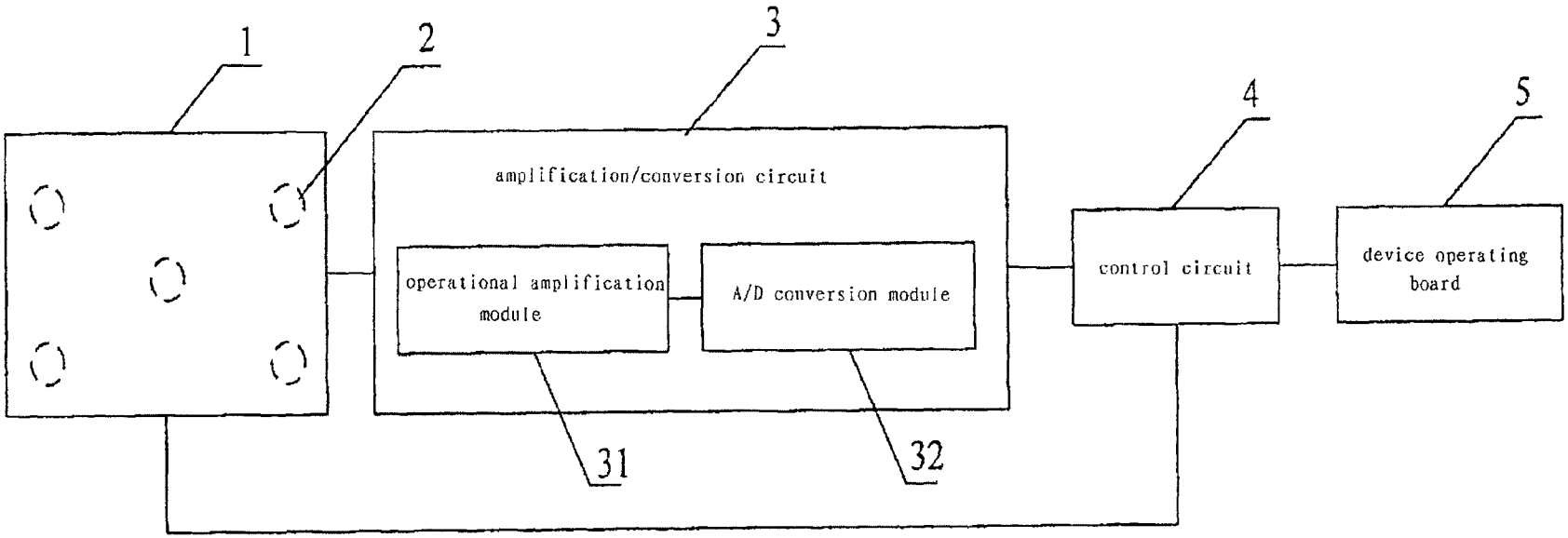
FIG. 3 is a schematic view of structure of a system for automatically adjusting luminance of a backlight source of a second embodiment of the present invention.

Based on the first embodiment, as shown in FIG. 2 and FIG. 3, a device operating board 5 is required for providing the control signal for turning on or off the backlight source to the system and providing an operational environment for the user to set parameters. The device operating board 5 is connected to the control circuit 4 and includes a hardware platform and a software platform. The software platform is a software operation system for providing the control signal for turning on or off the backlight source. The hardware platform is an operating panel on which the user may set parameters such as preset time and backlight source luminance and so on, by buttons or in other manners. The user may set the backlight source luminance through the hardware platform, which quantifies the current value corresponding to the backlight source luminance set by the user and then sends it to the control circuit 4. The receiving module 43 receives the current value and stores it into the memory 41. The preset time may also be set by the same way as above. Related information is initially stored in the memory, and the data therein can be updated through the setting by the hardware platform. The control module includes a current switch 451. The device operating board 5 sends the control signal for turning on or off the backlight source to the control circuit 4. The receiving module 43 receives the control signal and then sends it to the microprocessor 41, via which the control signal is further sent to the control module 45. Then the control module 45 controls the closing or open of the current switch 451 according to the control signal. When the current switch 451 is closed, the backlight source is turned on; and when the current switch 451 is open, the backlight source is turned off.

In this embodiment, five photosensors are mounted on the center and four corners on the back of the backlight source, and connected with the control circuit via a control bus. Mounting the photosensors on the above positions can achieve a best effect with the premise of saving. Also, mounting the photosensors on the back of the backlight source can avoid reduction in the luminance due to coverage of the photosensors. However, sizes of the photosensitive elements are smaller with development of the fabrication process, and hence the light covered by the photosensitive elements is ignorable, thus the photosensitive elements can also be mounted on the front side of the backlight source, that is, in the middle of the backlight source and the tested panel.

This embodiment is a preferred embodiment of the present invention. One or more photosensitive elements may be mounted on the front side or back side of the backlight source as required. The photosensitive elements can convert a light signal into an electric signal, such as photosensor, photodiode, photoresistor, or the like. In the case of mounting one photosensitive element, it may be mounted on the center of the backlight source.

Third Embodiment

Figure 4:
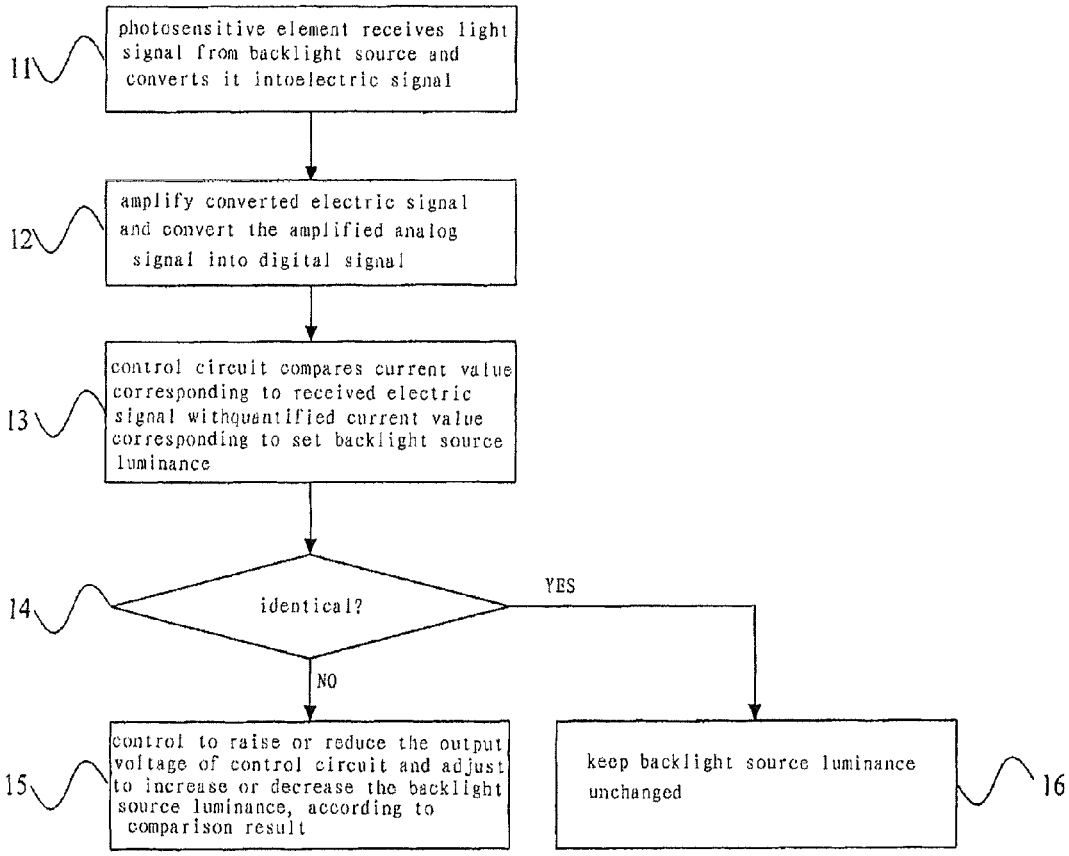
FIG. 4 is flowchart of a method of automatically adjusting luminance of a backlight source of the present invention.

FIG. 4 is schematic view of flowchart of automatically adjusting the luminance of the backlight source. In detection of a panel, firstly, the device operating board sends an operating signal for turning on the backlight source to the control circuit. The control circuit controls the current switch to be closed according to the received operating signal, then the backlight source and the photosensor begin to work. During the detection, at step 11, the photosensor obtains a light signal from the backlight source, converts the light signal into an electric signal, and sends the electric signal to the amplification/conversion circuit via a control bus. At this time, since the signal is an analog signal and is relatively weak, it should be amplified and converted into a digital signal. At step 12, after the amplification/conversion circuit receives the electric signal, it firstly amplifies the electric signal and then converts it into the digital signal. At step 13, after the control circuit receives the converted digital signal, it compares a current value corresponding thereto with a quantified current value (preset in the memory) corresponding to a set luminance of the backlight source. At step 14, it is judged whether the comparison result indicates identical. If not, it indicated that the luminance of the backlight source changed, that is, when the luminance of the backlight source increases or decreases, it can be found by the comparison result that the current value corresponding to the received digital signal is increased or decreased with respect to the quantified current value corresponding to a normal luminance, so step 15 is carried out, in which the control circuit accordingly controls the output voltage of the control circuit, i.e. the input voltage of the backlight source to decrease or increase, the luminance of the backlight source is reduced or raised to keep the luminance of the backlight source stable. If the comparison result indicates identical, it indicates that the luminance of the backlight source is not changed, so step 16 is carried out to keep the luminance of the backlight source unchanged. Through comparison and control effect of the control circuit, the existing manual adjusting manner is changed and convenience and accuracy of the adjustment are improved.

Fourth Embodiment

During turning-on of the backlight source, if no detection is performed in a period of time while the backlight source is still in the on state, it causes the power waste and aging of the device, so the backlight source should be turned off. The user may send an operating command for turning off the backlight source to the control circuit via the device operating board. After the receiving module in the control circuit receives this command, a turning-off signal is sent to the control module through the microprocessor to control the current switch to be open and therefore turn off the backlight source. The approach to turn off manually by the user is described above. The present invention also provides a method of automatically turning off the backlight source by the system. When the detection is stalled, if the receiving module in the control circuit does not receive any operating signal from the device operating system for a predetermined time (which, for example, the predetermined time may be set to 3 minutes or 5 minutes, and the like), the microprocessor sends the command for turning off the backlight source so as to control the current switch to be open and therefore turn off the backlight source. This approach is that the system automatically controls the turning off of the backlight source according to the predetermined time, and thus saves electric power and human efforts. The predetermined time may be preset and stored in the memory in advance. Other approaches may also be used to realize automatic control for turning on or off the backlight source. For example, it may be realized by controlling the main power source of the system by the control circuit and will not be limited to the solutions proposed in the embodiment.

In the backlight-source-luminance auto-adjusting system and method of the present invention, the photosensitive element and the control circuit, and the device operating board and the control circuit may communicate in a manner of wired or wireless connection. If the wireless communication is used, wireless communicating modules should be incorporated into the device operating board and the control circuit accordingly.

Finally, the invention is thus described, it will be obvious that the same may be varied in many ways. Such variations are not to be regarded as a departure from the spirit and scope of the invention, and all such modifications as would be obvious to those skilled in the art are intended to be included within the scope of the present invention.

What is claimed is:

1. A backlight-source-luminance auto-adjusting system including a backlight source, comprising:

a photosensitive element mounted on the backlight source, for converting a light signal into an electric signal;

an amplification/conversion circuit connected to the photosensitive element, for amplifying a received analog signal and converting said analog signal into a digital signal; and a control circuit connected to the amplification/conversion circuit and the backlight source, for receiving a signal sent by the amplification/conversion circuit and adjusting the backlight source, wherein said control circuit comprises:

a microprocessor for providing a control signal for adjusting the backlight source;

a memory connected to the microprocessor, for storing a quantified current value corresponding to a set luminance of the backlight source, and a preset time;

a receiving module connected to the microprocessor, for receiving an externally input signal;

a comparison module connected to the microprocessor, for comparing a current value corresponding to the received digital signal with the quantified current value corresponding to the set luminance of the backlight source; and a control module connected to the microprocessor, for controlling a level of an input voltage to the backlight source according to the control signal from the microprocessor, adjusting the luminance of the backlight source, and automatically turning on or off the backlight source according to the control signal.

2. The backlight-source-luminance auto-adjusting system of claim 1, wherein said control module includes a current switch for controlling the turning on or off of the backlight source.

3. The backlight-source-luminance auto-adjusting system of claim 1, wherein said microprocessor is a single-chip processor or PLC.

4. The backlight-source-luminance auto-adjusting system of claim 1, further comprising a device operating board connected to the control circuit, the device operating board comprising:

a hardware platform for providing an operation platform for parameter setting by a user; and a software platform for providing an operation signal of turning on or off the backlight source.

5. The backlight-source-luminance auto-adjusting system of claim 4, wherein said photosensitive element, amplification/conversion circuit, control circuit, and device operating board communicate with each other in a wired or wireless manner.

6. The backlight-source-luminance auto-adjusting system of claim 1, wherein the amount of said photosensitive elements is one or more.

7. The backlight-source-luminance auto-adjusting system of claim 1, wherein said photosensitive element is a photosensor or a photodiode or a photoresistor.

8. The backlight-source-luminance auto-adjusting system of claim 1, wherein said photosensitive element is mounted on front face and/or back face of the backlight source.

9. The backlight-source-luminance auto-adjusting system of claim 1, wherein said amplification/conversion circuit comprising:

an operational amplification module, for amplifying the received analog signal; and a conversion module connected to the operational amplification module, for converting the analog signal into the digital signal.

10. The backlight-source-luminance auto-adjusting system of claim 9, wherein said conversion module is an A/D conversion circuit or an AD/DA conversion circuit.

11. A backlight-source-luminance auto-adjusting method, comprising:

receiving a light signal of a backlight source, and converting the light signal into an electric signal;

amplifying the converted electric signal, and converting the amplified analog signal into a digital signal;

comparing a current value corresponding to the digital signal with a qualified current value corresponding to a set luminance of the backlight source;

controlling an output voltage of a control circuit to increase or decrease according to the comparison result, and adjusting to increase or decrease the luminance of the backlight source;

the control circuit automatically turning on the backlight source when receiving a turning-on signal; and the control circuit automatically turning off the backlight source when receiving a turning-off signal or not receiving any operation signal for a predetermined period.

* * * * *